US005201639A

United States Patent [19]

Reineck

[11] Patent Number: 5,201,639

[45] Date of Patent: Apr. 13, 1993

[54] IN-LINE HAND PUMP DEVICE

[76] Inventor: Donald R. Reineck, 9296 Mulberry Rd., Blissfield, Mich. 49228

[21] Appl. No.: 845,048

[22] Filed: Mar. 3, 1992

[51] Int. Cl.[5] ..... F04B 41/00; F04B 21/04

[52] U.S. Cl. ..... 417/236; 417/546

[58] Field of Search ..... 417/236, 545, 546, 547, 417/548, 549, 550, 551, 552, 553, 554, 437; 92/138, 5 R

[56] References Cited

U.S. PATENT DOCUMENTS

| | | | |
|---|---|---|---|
| 2,648,581 | 8/1953 | Karow | 92/138 |
| 2,928,375 | 3/1960 | Herrmann | 92/138 |
| 3,684,410 | 8/1972 | Fitzgerald | 417/554 |
| 3,787,149 | 1/1974 | Dane | 417/554 |
| 4,102,427 | 7/1978 | Sabec | 92/138 |
| 4,679,452 | 7/1987 | Stoll | 92/5 R |

FOREIGN PATENT DOCUMENTS

| | | | |
|---|---|---|---|
| 2754 | of 1860 | United Kingdom | 417/547 |

*Primary Examiner*—Richard A. Bertsch
*Assistant Examiner*—Roland McAndrews
*Attorney, Agent, or Firm*—Marshall & Melhorn

[57] ABSTRACT

A device for providing auxiliary pumping capabilities for a sump pump system and other low volume pumping systems. The in-line pumping device includes a tubular element with threaded ends to be mounted in the discharge pipe line of a sump pump system. A piston in the tubular element may be reciprocated by manually moving a drive shaft extending laterally from the piston through a threaded boss in the tubular element. A valve means permits the unidirectional flow of fluid through a center bore in the piston. If the electric pump is inoperable, the manual pump of the present invention may be used to pump liquid from the sump through the discharge pipe line.

18 Claims, 2 Drawing Sheets

IN-LINE HAND PUMP DEVICE

BACKGROUND OF THE INVENTION

1. Field of Invention.

This invention relates to a hand pump device, and more particularly, to a hand pump mounted in a standard piece of PVC pipe for connection in series with other pieces of pipe to provide manual pumping capabilities.

2. Description of Related Art.

In most residential basements, a pit or sump is included in the floor of the basement to collect water from around the foundation of the house. The water that collects is pumped from the pit through a pipe which extends to a discharge or drain system outside of the house. If the pump operates as intended, a sump pump system can typically prevent water from flooding the floor of the basement.

In general, a sump pump system includes a submersible pump operated by electrical power. The sump pump system also includes a flotation device which turns the submersed pump on when the water in the pit reaches a predetermined level. After the water is pumped from the pit through a discharge pipe to the outside of the house, the floatation device turns the pump off.

A major problem with a sump pump system may occur when the electrical power is interrupted. In most systems, there is no auxiliary pumping capability when the electric motor cannot pump because of the loss of electrical power. Electrical power is most often interrupted during a major storms with heavy precipitation, the precise time during which a basement is most likely to flood.

Existing auxiliary systems may be expensive, difficult to use, or difficult to maintain and operate. A gasoline driven generator can be used to provide emergency power when electrical power is lost. The generator is an expensive back-up system which is bulky and difficult to conveniently mount near the sump pump. The motor generator should be tested on a regular basis and requires routine maintenance to ensure proper operation.

In addition to the electric pump, sump pump systems also include a piping system to discharge the liquid collected in the pit. Polyvinyl chloride (PVC) pipes are presently used on a regular basis for water and sewer pipes in residential buildings, including sump pump discharge pipes. PVC pipe is much lighter and easier to install and maintain than copper tubing, iron pipe, or other pipe materials. Because of the convenience and ease of connecting various PVC pipe segments, residential home builders and owners now desire a simple and cost effective in-line pump for auxiliary sump pump system service.

SUMMARY OF THE INVENTION

In accordance with the present invention, there is provided a manual pump device having a tubular enclosure with means for coupling the tubular enclosure to the discharge pipe of a sump pump system. This manual pump device may also be used for other small pumping applications when electrical pumping capabilities are not available.

The tubular element has an opening at each end. At least one valve means is disposed within the tubular element to permit flow of liquid in one direction and prohibit flow in the opposite direction.

The pump includes a piston located in the tubular element. The piston has a full length center bore. Pressure created by reciprocating the piston in a longitudinal direction in the tubular element forces water through the center of the piston from one end of the tubular element to the other. The piston has a circular seal on each end to engage the tubular element and prevent leakage along the outer surface of the piston.

The piston is driven by a lateral drive shaft inserted through an aperture in the side of the tubular element. The drive shaft includes a ball and socket joint to permit proper operation of the drive shaft and to seal the opening of the tubular element and prevent leakage around the aperture.

The end of the drive shaft inside the tubular element extends from one side of the piston, across the center bore, through a slot in the other side of the piston, and through the aperture in the tubular element. The external end of the drive shaft has a handle for gripping the drive shaft. When the handle is reciprocated about the ball and socket joint in a longitudinal direction, the piston moves in a reciprocal manner to deliver water from one end of the tubular element to the other end.

An object of the present invention is to provide a low cost pumping system requiring only manual power for operation for auxiliary service use when electrical power is interrupted to conventional electric sump pump motors.

Another object of the present invention is to provide a pumping system that can be integrally installed in a new or existing sump pump line without requiring special mounting or complicated connection procedures.

A further object of the present invention is to provide a pumping system that is uncomplicated and easy to use in emergency situations, such as a flooding basement. Since the pump is mounted directly in the discharge line, no set-up time or special preparation is required.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figures 1, 2:
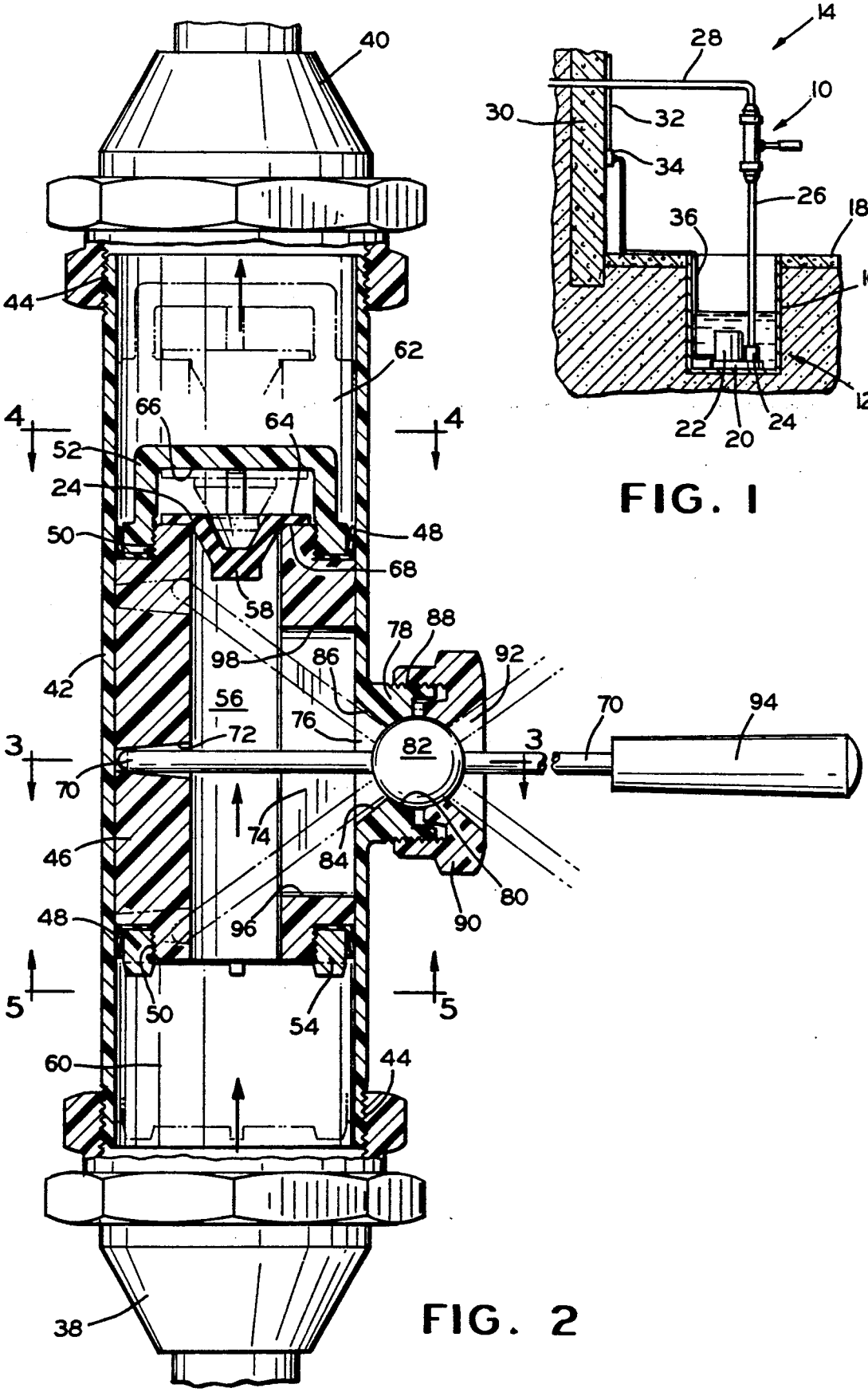
FIG. 1 is a side elevational view of the present invention mounted in the discharge line of a typical sump pump system.
FIG. 2 is a longitudinal sectional view of the pump device shown in FIG. 1.

Referring now to the drawings, there is illustrated in FIGS. 1 and 2 the in-line hand pump device 10 of the present invention. As shown in FIG. 1, the pump 10 may be integrally mounted as part of a standard basement sump pump system 12. A basement 14 with a sump pump system 12 will typically have a pit 16 included in the floor 18 of the basement 14. Water and other liquids around the foundation of the basement 14 are directed to the pit 16 and are pumped from the pit 16 to a discharge or drain system outside of the basement 14.

The typical sump pump system 12 includes a base 20 on which the electrical pump 22 and check valve 24 are mounted. The liquids which collect in the pit 16 are pumped from the pit 16 through a discharge pipe to an outside drain or discharge (not shown). The pump 22 is a submersible pump with an electric motor. A floatation switch is used to turn the pump 22 on and off. Electrical power for the pump 22 is usually furnished from electrical conduit 32 through receptacle 34 to the power cord 36 of the pump 22.

The pump 10 of the present invention provides auxiliary pumping capabilities in circumstances where the sump pump system 12 becomes inoperable due to loss of electricity or other problems with the pump 22. The discharge pipe 26 extends from the pit 16 and is connected to one end of pump 10 above the level of the floor 18. The other end of the pump 10 is connected to another piece of discharge pipe 28 which extends from the pump 10 through the basement wall 30 to discharge the liquid from the pit 16 outside of the basement 14.

The pump 10 is mounted in the discharge line and requires no power connections, special mounting support, or mounting frame. The discharge pipes 26 and 28 are typically made of polyvinyl chloride (PVC) and can be furnished with adapters 38 and 40 for convenient in-line mounting of the pump 10, as shown in FIG. 2. The pump 10 has an outer tubular element 42, which may also be made out of PVC or other suitable material. The diameter of the tubular element 42 can be selected to accommodate standard size adapters, such as a 4" tubular element 42 with 4"-1.5" adapters 38 and 40. The tubular element 42 is provided with threads 44 at both ends to facilitate coupling to the adapters 38 and 40.

A piston 46 is mounted inside the tubular element 42 such that the outer surface of the piston 46 engages the inner surface of the tubular element 42. An accurate fit is required to maintain the efficiency of the pump 10. The fit must be tight enough to limit water from passing between the outer surface of the piston 46 and the inner surface of the tubular element 42 without restricting the reciprocating movement of the piston 46.

Figure 4:
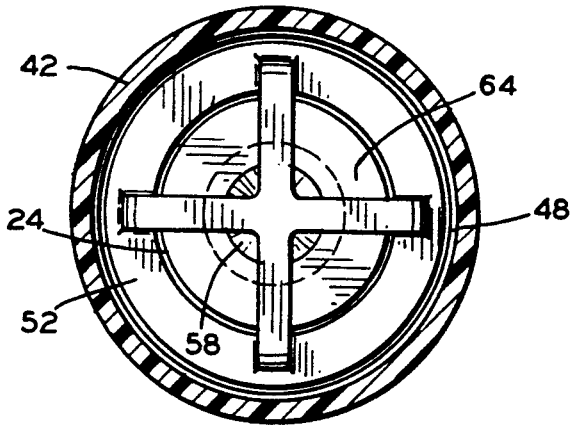
FIG. 4 is a sectional view taken along line 4—4 of FIG. 2.
Figure 5:
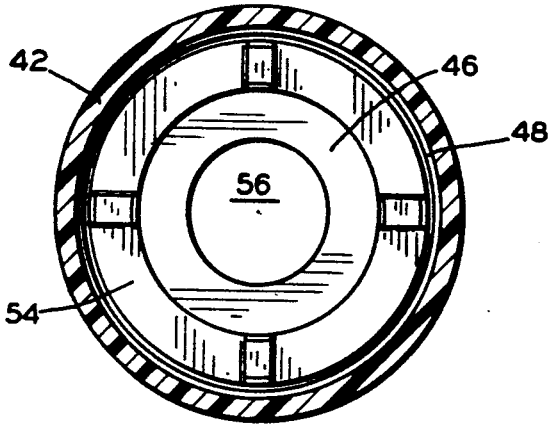
FIG. 5 is a sectional view taken along line 5—5 of FIG. 2.

The ends of the piston 46 include threaded extensions 50 with circular seals 48 mounted about the extensions 50. The seals 48 engage the inner surface of the tubular element 42 and prevent water from passing over the outer surface of the piston 46. FIG. 4 shows the valve end of the piston 46, in which a circular valve retainer nut 52 threadably engages the threaded extension 50 to retain the seal 48 and limit the movement of valve 58 relative to piston 46. On the other end of the piston 46, as shown in FIG. 5, a standard circular nut 54 engages the threaded extension 50 to retain the seal 48.

The piston 46 has a center bore 56 to facilitate the flow of liquid from one end of the piston 46 to the other end as the piston is reciprocated in the tubular element 42. A free-floating one-way valve 58 is mounted at one end of the center bore 56. The one-way valve 58 permits the liquid to flow only from the input tubular segment 60 to the output tubular segment 62 as shown by the direction of the arrows in FIG. 2.

When liquid is forced in the direction of the arrows by either the electrical pump 22 or the pump 10 of the present invention, the valve 58 is open to permit passage of liquid through the center bore 56. When the valve 58 is open, the outer surface edges 64 of the valve 58 engage the top 66 of the valve retainer nut 52. When liquid tends to flow in the opposite direction, the valve 58 closes. In the closed position, the inner surface edges 68 of the valve 58 engage the end of piston 46 to cover the center bore 56 and prevent the passage of liquid between tubular output segment 62 and the tubular input segment 60.

The reciprocal movement of the piston 46 in the tubular element 42 is achieved by the manual movement of drive shaft 70. One end of the drive shaft 70 is positioned in a notch 72 on one side of the piston 46. The drive shaft 70 extends across the center bore 56 and through a longitudinal piston slot 74 on the other side of the piston 46. The drive shaft 70 extends through a slotted, longitudinal aperture 76 in the side wall of tubular element 42.

Figure 3:
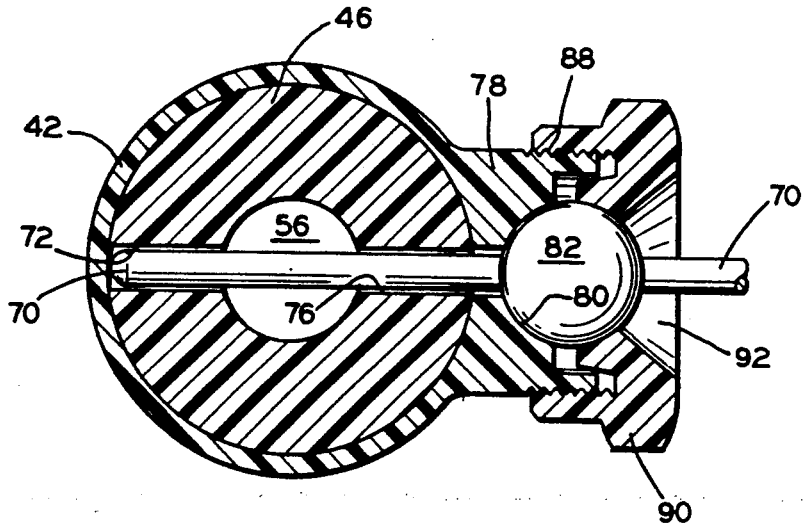
FIG. 3 is a sectional view taken along line 3—3 of FIG. 2.

As shown in FIGS. 2 and 3, the tubular element 42 has an externally threaded, circular boss 78 with a tapered internal slot which forms an integral part of the slotted aperture 76. The circular boss 78 has a socket so formed in its outer surface for receiving a ball 82 mounted on the drive shaft 70. The engagement of the ball 82 in the socket so seals the aperture 76 to prevent leakage of liquid from the aperture 76. The tapered surfaces 84 and 86 of the aperture 76 limit the reciprocal movement of the drive shaft 70 during operation of the pump 10.

A nut 90 with a conical shaped center element 92 threadably engages the external threads 88 of the boss 78 such that the center element 92 engages the ball 82. The force exerted on the ball 82 as the nut 90 is tightened ensures a proper seal between the socket so and the ball 82. The end of the drive shaft 70 extending outwardly from the ball 82 is provided with a handle 94.

The handle 94 may be used to move the drive shaft 70 in a longitudinal, reciprocal manner about the ball 82, which causes the other end of the drive shaft 70 to reciprocate within the slotted aperture 76 and the piston slot 74. The longitudinal forces transferred to the end of the drive shaft 70 engaging the piston 46 in notch 72 causes the piston 46 to reciprocate within the tubular element 42.

The end of the drive shaft 70 should remain in the notch 72 of piston 46 during operation. Consequently, the range of movement of the piston 46 is limited by engagement of the external segment of the drive shaft 70 with the center element 92 of the nut 90, or by the engagement of the internal segment of the drive shaft 70 with the tapered surfaces 84 and 86 of the aperture 76. The longitudinal length of the piston slot 74 must be of sufficient length such that the slot surfaces 96 and 98 do not bind the drive shaft 70 as the piston 46 is reciprocated.

The sump pump system 12 discharges liquid through the same discharge pipes 26 and 28 when either the electric pump 22 or the manual pump 10 of the present invention is used. Valve 24 is a one-way valve. When the electric pumped is turned on, the water passes from the pit 16 through valve 24 and discharge pipe 26 to the pump 10. The liquid is pumped through the tubular input segment 60 and the center bore 56 with sufficient force to open valve 58 and allow the liquid to pass through the tubular output segment 62 and out the discharge pipe 28.

When the electrical pump 22 is inoperable, the pump 10 may be manually operated to pump the liquid from the pit 16. As shown in FIGS. 1 and 2, when the handle 94 is moved downward and the piston 46 is raised, valve 58 closes and a partial vacuum is created beneath the piston. Liquid is thereby drawn from the pit 16 through valve 24. When the handle 94 is moved upward and the piston 46 is pushed downward, valve 24 closes, valve 58 opens, and liquid is drawn through the discharge pipe 26 until the liquid reaches the tubular input segment 60 and passes through the center bore 56 into the tubular output segment 62. When the piston 46 is raised again, valve 24 opens and valve 58 closes. Liquid in the tubular output segment 62 is lifted by the piston 46 and is forced out the discharge pipe 28. At the same time, liquid is drawn from the pit 16 to the pump 10. This process continues as the piston 46 is reciprocated in the tubular element 42 by the manual movement of the drive shaft 70.

In addition to sump pump system applications, the present invention could be used in other applications, such as a portable pump with flexible hoses connected to the ends of the pump 10. A second valve (not shown) could be added in the tubular input segment 60 to facilitate efficient pump operation.

In accordance with the provisions of the patent statutes, the present invention has been described in what is considered to represent its preferred embodiment. However, it should be noted that the invention can be practiced otherwise than a specifically illustrated and described without departing from its spirit or scope.

What is claimed is:

1. A hand pump device comprising:

a) a tubular element provided with an opening at an input end and an opening at an output end, the input end and output end each being adapted for in-line connection to a segment of pipe;

b) a piston provided with a linear center bore extending the full length of said piston, said piston being disposed within said tubular element such that an outer surface of said piston slidingly engages an inner surface of said tubular element;

c) valve means mounted on said piston and extending across the center bore; and d) drive means extending laterally from said piston through a side aperture in said tubular element for reciprocating said piston longitudinally within said tubular element whereby liquid is forced from the input end of said tubular element through the center bore of said piston and through said valve means to the output end of said tubular element.

2. The hand pump device defined in claim 1 wherein said tubular element is formed from a polymeric material.

3. The hand pump device defined in claim 1 wherein said tubular element is formed of polyvinyl chloride.

4. The hand pump device defined in claim 1 wherein the input end and the output end of said tubular element include a threaded outer surface for threadably engaging a pipe adaptor.

5. The hand pump device defined in claim 1 including a seal mounted on an input end of said piston and a seal mounted on an output end of said piston whereby the seals engage the inner surface of said tubular element.

6. The hand pump device defined in claim 5 wherein the input end and the output end of said piston each include a threaded extension and a nut for mounting and securing a seal.

7. The hand pump device defined in claim 1 wherein said drive means includes a drive shaft mounted to reciprocate about a joint proximate to the side aperture in said tubular element.

8. The hand pump device defined in claim 7 including a threaded boss formed about the side aperture in said tubular element.

9. The hand pump device defined in claim 8 wherein said threaded boss includes a first longitudinal slot extending across the side aperture in said tubular element.

10. The hand pump device defined in claim 9 wherein said piston includes a second longitudinal slot for acceptance of the drive shaft, the second longitudinal slot extending from the center bore to the outer surface of said piston and communicating with the first longitudinal slot of the threaded boss.

11. The hand pump device defined in claim 10 wherein said piston includes a notch for acceptance of the drive shaft, the notch opening towards the center bore opposite the second longitudinal slot.

12. The hand pump device defined in claim 9 wherein the threaded boss includes a slotted socket and the drive shaft includes an integrally mounted ball, whereby the socket and ball form a reciprocating joint about which the drive shaft may reciprocate.

13. The hand pump device defined in claim 12 including a nut to retain the ball of the drive shaft in the socket.

14. The hand pump device defined in claim 13 wherein said nut includes a conical-shaped center opening.

15. A hand pump device comprising:

a) a tubular element including a threaded opening at an input end and an output end of said tubular element, and a first longitudinal slot encircled by a threaded boss in a side of said tubular element;

b) a piston disposed within said tubular element, said piston including a full length longitudinal center bore, a second longitudinal slot, and a notch in said piston, the second longitudinal slot and notch being aligned on opposite sides of the center bore;

c) valve means mounted on said piston and extending across the center bore; and d) a drive shaft inserted into the notch in said piston and passing through the center bore, the second longitudinal slot, and the first slot to extend laterally from said tubular element, whereby manual reciprocation of said drive shaft will cause liquid entering the input end of the tubular element to be forced through the center bore and out the output end of the tubular element.

16. The hand pump device defined in claim 15 wherein the threaded boss includes a slotted socket and the drive shaft includes an integrally mounted ball whereby the socket and ball form a reciprocating joint about which the drive shaft may reciprocate.

17. The hand pump device defined in claim 15 wherein said tubular element is formed from a polymeric material.

18. A hand pump device for providing manual pump capabilities in a sump pump system, whereby a hand pump is mounted in a piece of pipe for connection in series with other pieces of pipe in the discharge line of the sump pump system, which hand pump device comprises:

a) a polymeric pipe segment including a threaded opening at an input end and at an output end of said pipe segment, and a first longitudinal slot encircled by a threaded boss in a side of said pipe segment;

b) a piston disposed within said pipe segment, said piston including a full length longitudinal center bore, a second longitudinal slot, and a notch in said piston, the second longitudinal slot and the notch being aligned on opposite sides of the center bore;

c) valve means mounted on said piston and extending across the center bore; and d) a drive shaft inserted into the notch in said piston and passing through the center bore, the second longitudinal slot, and the first slot to extend laterally from said pipe segment, whereby manual reciprocation of said drive shaft will cause liquid entering the first end of the pipe segment to be forced through the center bore and out the second end of the pipe segment.

* * * * *